United States Patent [19]

Lancaster

[11] Patent Number: 4,807,907

[45] Date of Patent: Feb. 28, 1989

[54] ARTICLE OF STATIONERY

[76] Inventor: Anthony E. Lancaster, 26 Felton Road, Parkstone, Poole, Dorset BH14 OQS, England

[21] Appl. No.: 2,209

[22] Filed: Jan. 12, 1987

[30] Foreign Application Priority Data

Feb. 28, 1986 [GB] United Kingdom ..... 8604967

[51] Int. Cl.[4] ..... B41L 1/20; B41L 1/00; B42D 3/18; B42D 15/00

[52] U.S. Cl. ..... 282/9 R; 282/1 R; 281/1

[58] Field of Search ..... 282/1 A, 1 R, 3 R, 3 B, 282/4, 12 R, 9 R; 283/1; 281/1, 2, 3 A, 4, 5, 7, 12, 14

[56] References Cited

U.S. PATENT DOCUMENTS

| | | | |
|---|---|---|---|
| 555,748 | 3/1896 | Sunderlin | 282/9 R |
| 683,782 | 10/1901 | Morland | 282/9 R |
| 756,258 | 4/1904 | Mallin | 282/9 R |
| 1,391,872 | 9/1921 | White | 282/9 R |
| 1,670,822 | 5/1928 | Phillips | 282/9 R |
| 1,980,318 | 11/1934 | Caton | 282/9 R |

*Primary Examiner*—Paul A. Bell
*Assistant Examiner*—Paul M. Heyrana
*Attorney, Agent, or Firm*—Nixon & Vanderhye

[57] ABSTRACT

An article of stationery, suitable for making one or more copies of information applied to a top sheet, comprises a sheet, or a stack or sheets, of substantially plain action paper with a flap removably attached to the sheet, or the stack of sheets, of action paper and extending over an edge portion of the sheet, or the uppermost sheet. The flap permits a top sheet of non-action paper to be introduced beneath the flap to overlie the action paper so that the edges of the top sheet and the action paper can be aligned.

2 Claims, 1 Drawing Sheet

Fig. 1.
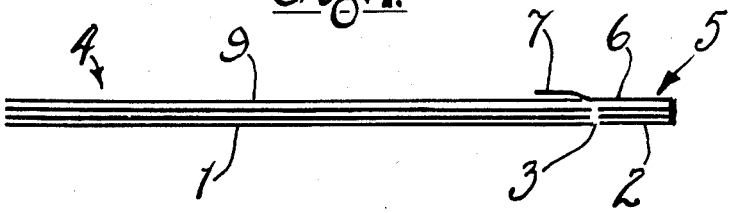
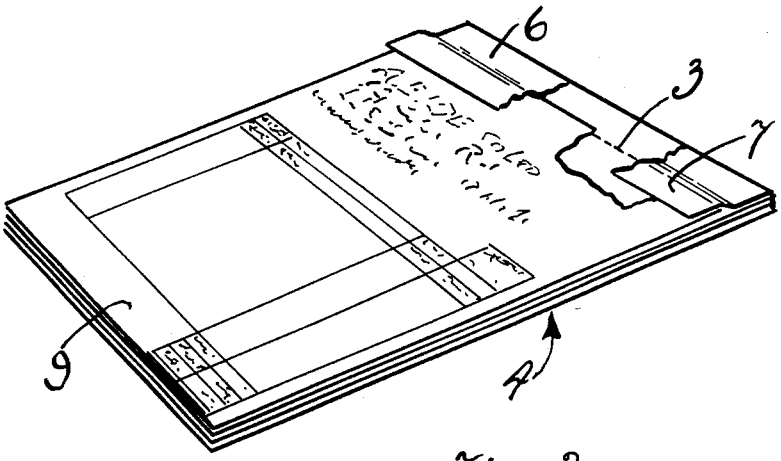
Fig. 2.

ARTICLE OF STATIONERY

FIELD OF THE INVENTION

This invention relates to articles of stationery which permit copies to be readily produced when information is placed on a sheet of paper, for example, by typing.

BACKGROUND OF THE INVENTION

The invention makes use of so-called "action paper" which is a well-known type of paper and which has a surface coating of dye capsules that, upon impact or rupture, give an impression upon a contacting sheet of paper. Such action paper can be purchased in the U.K. from Wiggins, Teape Limited. Such action paper is available in a variety of forms and is sometimes known as carbonless copy paper or self-copying paper.

Action paper enables a copy to be readily made of information placed upon it by writing, typing or the like, without the need for separate sheets of carbon paper. Action paper is often used for multiple business forms where several copies of all written or typed information are required. For instance, the top sheet of an invoice is given to the customer and successive copies of the invoice are required for stock control records, internal accounting systems and general house files and the like. Clearly, a number of identical sheets of action paper could be arranged in a stack and the information placed by the user on the top sheet. Usually, however, the appearance of the action paper is such tht it does not appeal as a top sheet suitable for giving to the customer and it is usual to employ a better quality paper for the top sheet that is eventually handed to the customer.

It has been the practice heretofore to print the same information on each sheet of the action paper as is present on the top sheet, i.e. the letter heading and other standard information. In this case, the stacks of action paper, each with a top sheet of good appearance, have to be prepared for each user and thereby a limited number of each stack is required.

It is much more efficient if the action paper is plain and does not carry the printed matter present on the top sheet as this means that the stacks of action paper are the same for all users.

OBJECTS OF THE INVENTION

It is an object of the invention to provide an article of stationery, comprising action paper of improved versatility and cost efficiency.

It is a further object of the invention to provide an article of stationary comprising a stack of sheets of action paper of improved versatility and cost efficiency.

These and other objects of the invention will become apparent from the following description and claims.

SUMMARY OF THE INVENTION

According to the present invention, an article of stationery comprises a sheet of substantially plain action paper having a flap removably attached thereto and extending over an edge portion of the action paper, said flap permitting an edge portion of a sheet of non-action paper to be introduced beneath the flap so as to temporarily overlie the sheet of action paper and for edges of the non-action paper to be aligned with corresponding edges of the action paper.

In this way, the sheet of action paper with the flap removably attached thereto is standard and can be supplied to all users and only the top sheet, which is introduced beneath the flap, is unique to each particular user. The user places his printed top sheet beneath the flap to overlie the sheet of action paper with the edges of the top sheet aligned with the corresponding edges of the action paper. Information placed on the top sheet, either in manuscript or by typing or printing, is transferred to the action paper which can readily be separated from the flap, thereby producing a copy of the information added to the top sheet.

Clearly, it is often desirable for more than one copy to be produced of anything added to a printed top sheet and, to this end, according to a second aspect of the present invention, an article of stationery comprises a plurality of sheets of substantially plain action paper arranged in a stack and temporarily secured together with a flap removably attached to the stack and extending over an edge portion of the uppermost sheet in the stack, said flap permitting an edge portion of a sheet of non-action paper to be introduced beneath the flap so as to temporarily overlie the sheets of action paper and for the edges of the non-action paper to be aligned with the corresponding edges of the action paper.

Although the action paper is nominally plain, that is, it does not contain the information normally printed on the top sheet, it may have lightly printed information thereon such as the word "copy" and the manufacturer's trade mark and the like.

BRIEF DESCRIPTION OF THE DRAWINGS

FIG. 1 is a side elevation of an article of stationery in accordance with the invention; and FIG. 2 is a perspective view of the article.

DESCRIPTION OF THE PREFERRED EMBODIMENTS

A sheet of action paper 1 of, say, A4 size has a header strip 2 with a row of perforations 3 between them. A plurality, of, say, four such sheets are arranged to form a stack 4 with the perforations 3 aligned. A strip of paper 5 has a header portion 6 and a flap portion 7. The strip is arranged on the top of the stack and the header portion 6 is positioned above the header strips 2 of the sheets of action paper. In the arrangement shown the flap 7 overlies the perforations in the sheets of action paper. Apart from possibly the word "copy" and a trade mark of the manufacturer, the articles of stationery, consisting of the sheets of action paper and the strip which provides the flap, do not have any printing on them which would prevent them from being used by a large number of users. Each user, however, has his own supply of top sheets 9 which are printed to include information which is unique to the user concerned, for example, the name and address of the user, and other information and markings.

In use, the user takes a top sheet 9 and slides the upper edge beneath the flap 7 and aligns the side portions of the top sheet with the corresponding side portions of the stack of action paper. Information is then added to the top sheet in manuscript, or the complete stack along with the top sheet can be placed in a typewriter or printer so that information can be placed thereon. As the information is written or printed thereon, it is copied on to each of the sheets of action paper. When the operation is complete, the top sheet is simply removed from beneath the flap 7 and the sheets of action paper are torn away along the perforations from the header strips 2. The header strips 2 and the strip 5 providing the flap may be secured together by an adhesive.

Although the flap is shown at the top of the stack of action sheets, it could be positioned along any one side of the stack.

Although there may be only one sheet of action paper, it is usual for two, three or four sheets to be arranged in the stack.

What I claim is:

1. An article of stationery comprising:

a sheet of substantially plain action paper, said sheet having a portion extending along one edge thereof, said portion and the remaining part of said sheet being separated by perforations;

a flap attached to said portion of said sheet and extending over said edge and over a part of an upper surface of said sheet adjacent to said edge;

said flap, in use, permitting an edge portion of a sheet of non-action paper to be introduced beneath said flap so as to temporarily overlie said sheet of action paper and so as to temporarily locate said non-action paper over said sheet of action paper as required.

2. An article of stationery as claimed in claim 1, in which said sheet of action paper is the top sheet of a plurality of sheets of action paper arranged in a stack, each of said sheet of action paper having a portion of the sheet and the remaining part of the sheet readily separable from each other, with said portions being adhesively secured together.

* * * * *